US008764016B2

(12) United States Patent
Stewart

(10) Patent No.: US 8,764,016 B2
(45) Date of Patent: Jul. 1, 2014

(54) ELECTRONIC SCORING TARGET BOARD

(75) Inventor: Mark F Stewart, St. Davids (CA)

(73) Assignee: Optima Global Corporation

( * ) Notice: Subject to any disclaimer, the term of this patent is extended or adjusted under 35 U.S.C. 154(b) by 2092 days.

(21) Appl. No.: 10/543,219

(22) PCT Filed: Jan. 23, 2004

(86) PCT No.: PCT/CA2004/000083
§ 371 (c)(1),
(2), (4) Date: May 11, 2006

(87) PCT Pub. No.: WO2004/065888
PCT Pub. Date: Aug. 5, 2004

(65) Prior Publication Data

US 2007/0001400 A1 Jan. 4, 2007

(30) Foreign Application Priority Data

Jan. 24, 2003 (CA) ..... 2417222

(51) Int. Cl.
*F41J 5/00* (2006.01)
*F41J 5/04* (2006.01)

(52) U.S. Cl.
USPC ..... 273/374; 273/371; 273/372; 273/373; 273/377; 273/378

(58) Field of Classification Search
USPC ..... 463/7; 273/371–374, 377–378; 200/5 A; 473/578
See application file for complete search history.

(56) References Cited

U.S. PATENT DOCUMENTS

| | | | | |
|---|---|---|---|---|
| 3,101,198 | A | 8/1963 | Williams | 273/102.2 |
| 3,275,321 | A | 9/1966 | Forest | 273/102.2 |
| 3,677,546 | A | 7/1972 | Oetiker | 273/102.2 R |
| 4,014,546 | A | 3/1977 | Steinkamp | 273/102.2 S |
| 4,216,968 | A * | 8/1980 | Yeeda | 273/376 |
| 4,244,583 | A | 1/1981 | Wood et al. | 273/373 |
| 4,651,998 | A | 3/1987 | Holt et al. | 273/347 |
| 4,804,193 | A | 2/1989 | Lin et al. | 273/376 |
| 4,852,888 | A | 8/1989 | Ross | 273/373 |
| 5,486,007 | A | 1/1996 | Stewart | 273/374 |
| 5,613,685 | A | 3/1997 | Stewart | 273/374 |

FOREIGN PATENT DOCUMENTS

| | | | |
|---|---|---|---|
| DE | 200 10 161 U1 | 9/2000 | F41J 5/04 |
| FR | 2774 466 | 8/1999 | F41J 7/00 |
| GB | 1 532 744 | 11/1978 | F41J 3/00 |

* cited by examiner

*Primary Examiner* — Werner Garner
(74) *Attorney, Agent, or Firm* — Gardere Wynne Sewell LLP

(57) ABSTRACT

A target (1) for use with a projectile has a web (7) defining a target face and a back board (29). The target face is divided into multiple segments (3, 5). A cup (19) filled with a projectile-receptive insert material (27) is mounted for sliding within each segment. Each cup has one or more resilient cushions (35) between the cup and the back board. Each cushion has at least one electroconductive area. The back board has pairs of switch contacts (25), forming electrical switches. The projectile impacting a cup at the target face with sufficient force causes the cup to slide within the segment urging the electroconductive area of the one or more cushions to touch the switch contacts, resulting in closing of the switch defined by the switch contacts and signaling a hit to onboard electronic circuitry. The at least one cushions beneath that cup return the cup substantially to its original position.

32 Claims, 13 Drawing Sheets

ELECTRONIC SCORING TARGET BOARD

FIELD OF THE INVENTION

The invention relates to a target board systems with electronic scoring. More particularly, it relates to such systems where the system is capable of indicating the location of the dart within a given segment of the board.

BACKGROUND OF THE INVENTION

An automated dartboard system has a number of advantages, such as knowledge of when a match has commenced and when it has ended. This allows the system to use automated revenue collection means, such as are used in video or arcade games.

As shown by the art in this field, many attempts have been made to create such a system. One popular system has been the type shown in British patent specification 1 532 744 of Jones et al. filed May 30, 1977, and published Nov. 22, 1978. Jones discloses a system employing plastic tipped darts and an array of target plates moulded with a large number of closely spaced holes corresponding substantially in size to that of the tip. When the dart is thrown at the board, the tip enters into one of the holes and remains in the hole until removed by one of the players. For automated scoring, a given target plate is slidably supported and, when a given target plate is struck by a dart, the plate slides inwardly to effect closure of an electrical switch contact which directs a signal to a scoring register.

Obviously, the Jones system is not designed to employ regulation grade metal tipped darts of the type preferred by serious dart players. The games are not sufficiently realistic for a wide segment of the market. In addition to the modifications required for reception and retention of grade metal tipped darts, the switches used and the plastic target plate struck by a dart are typically not strong enough to withstand continuous heavy impact from grade metal tipped darts.

Holt et al. in U.S. Pat. No. 4,651,998 issued Mar. 24, 1987 discloses a safe tip dart system such as that in Jones et al. Holt et al add a bullseye detection mechanism wherein the dart board deforms, or alternatively a plate slides within the board, to actuate a contact switch that causes a timer circuit to activate an audible alarm. This provides an additional attraction for playing the game. The Holt et al bullseye provides only a means to actuate a bullseye segment and only in conjunction with an all plastic safe tip dart board. As safe tip darts are being used, wear of the segments is not a factor, and no means is discussed for lengthening time between replacement or for facilitating replacement.

Automated regulation dart systems are shown in the following U.S. Pat. No. 4,852,888 issued Aug. 1, 1989 to Ross et al; U.S. Pat. No. 4,244,583 issued Jan. 13, 1981 to Wood et al.; U.S. Pat. No. 4,014,546 issued Mar. 29, 1977 to Steinkamp; U.S. Pat. No. 3,677,546 issued Jul. 18, 1972 to Oetiker; U.S. Pat. No. 3,275,321 issued Sep. 27, 1966 to Forest; U.S. Pat. No. 3,101,198 issued Aug. 20, 1963 to Williams. Dart conductive systems have a first conductive layer part of the way into the segment and a second conductive layer further into the segment. The conductive layers are at two different potentials. When the dart enters the segment it pierces the first layer and the second layer which causes current to flow between the layers and indicates the location of the dart. Ross et al., Forest and Williams disclose modified systems of this type.

Dart conductive systems wear out in the conductive layers as they are continually pierced. As well, darts may not pierce both layers and a score will not be recorded. This can happen when the dart has insufficient energy to reach both layers or the dart enters at an angle. It is also desirable to have the dart create an impulse contact, rather than a constant contact between the conductive layers. This simplifies the operation of circuitry in the system. For a system that operates on a continuous contact see Wood et al. Most dart conductive systems use a mechanical means of moving the dart from contact with one of the layers or moving one of the layers from contact with the dart. This adds complexity to the mechanical operation of the system.

U.S. Pat. Nos. 5,486,007 and 5,613,685 issued (on Jan. 23, 1996 and Mar. 25, 1997, respectively) to the inventor et al. disclose an automated dart board which overcome the shortcomings listed above. This dart board describes a target for darts that has a conductive rigid web made up of concentric rings intersecting spokes emanating from the second to the innermost ring. The spokes define sectors, while the rings define segments within each sector. Conductive blocks, made up of a metallic cup having contacts protruding from its bottom and containing a rubberized cork insert, fill in the segments of the web. Beneath each cup is a silicon foam cushion cut away between the contacts and a pad on a printed circuit board ("PCB"). The pads are each connected to circuitry that senses when a dart hits an insert causing the corresponding cup to slide within the web and contact a pad. The circuitry, by way of piezoelectric sensors, also determines if a dart has impacted on or near the target and checks to see if the target has polled a segment that indicates a hit on the target, failing which the target indicates that the dart missed the target. The circuitry also senses the rotational orientation of the target and sets the basic scores of the segments accordingly, allowing the target to be periodically rotated to reposition segments in sectors of heavy use to sectors of lighter use.

This system requires that the conductive web, of a relatively large area, be held at a known voltage (ground or voltage high). An electrostatic charge (ESD for electrostatic discharge) builds up on the top of surface of the conductive cups. This charge may affect the sensitive low voltage electronic circuitry mounted on the printed circuit board underneath.

Other perceived deficiencies or improvements may include the higher cost and heavy weight of a metal conductive web as opposed to a cheaper and lighter non-conductive plastic or composite web; the continued need to have a switching device that will withstand the impact of metal grade steel tip darts while still maintaining its dual dart (i.e. steel and plastic) feature.

It is an object of the invention to address these perceived deficiencies in the field or other needs as will become evident from the following description.

SUMMARY OF THE INVENTION

In a first aspect the invention provides a target for use with a projectile. Examples of such projectiles are regulation grade metal tipped darts, plastic tipped darts, target gun shooting (pellet, b.b. bullets), archery, dartguns, blowguns, and games that use projectiles that are not intended to remain in the target, such as balls striking the target. The target has a web. The web defines a target face and has a depth. The web also defines one or more segments within the web that open toward the target face. One or more blocks are mounted for sliding within the web and substantially fill the target face of one or more segments of the web. Each of the blocks has one or more resilient cushions, between each block and the back board. Each cushion has one or electroconductive areas. The back board has an array of switch contacts forming an electrical switch. The projectile impacts a block at the target face with sufficient force to cause the block for that insert to slide within the web and have the electroconductive area of the one or more cushion contact the switch contacts beneath that block, resulting in closing of the electrical switch defined by the switch contact. The one or more resilient cushions beneath that block return the block substantially to its original position.

In a second aspect the invention also provides a target for use with a projectile. This aspect is similar to the first, but the web must be rigid and the blocks are made up of cups and of inserts. The cups are mounted to slide within the web and fill the target face of one or more segments of the web. Each cup has a mouth that opens toward the target face. An insert is mounted within and fills each cup to the target face. The projectiles impact the inserts at the target face with sufficient force to cause the cup for that insert to slide within the web, and the cushion beneath that cup returns the cup substantially to its original position.

This target may also be used with projectiles that are darts. The insert in that case is formed from a material for receiving and retaining the darts. The insert could be formed from a material for refilling in behind the darts when they are removed.

The web could also take the shape of a traditional dart board with a series of concentric spaced apart rings and a series of equally spaced spokes emanating from the second to the innermost ring. The spokes define circular sectors, the two innermost rings define two segments, and intersecting spokes and rings define the remainder of the segments. The innermost ring could be connected by a quick release mechanism to the back board for quick removal of the innermost ring and easy access to the cup in the innermost ring in order to remove that cup from the target. The quick release mechanism could have at least one extension of the innermost ring through the back board, that extension would have a groove parallel to the back board for receiving a snap ring or other fastening device that maintains the back board snugly against the unextended portion of the innermost ring.

The back board could have a main board and a centre board, with the main board having an area beneath the inside diameter of the second to the innermost ring removed. The centre board in that case would extend beneath that area and overlap the main board. The previously mentioned extensions extend through the centre board. In addition, the second to the innermost ring has extensions through the centre board. The main board has projections beneath the unextended portion of the second to the innermost ring. These latter extensions also have a groove parallel to the centre board for receiving a snap ring or other fastening device that maintains the centre board and main board snugly against the unextended portion of the second to the innermost ring.

The web may have a tip on each of the rings and spokes. The tip extends into the segments and retains each of the cups. The tip may cover the face of the web and the rim of each cup. The tip could be made from a material that can withstand the impact of darts over a long period of use.

The inserts could be made from sisal. It is possible to glue the inserts to their respective cups. The cushions can be formed from elastomer.

The back board may be a printed circuit board and the pads are traces on the back board.

The target may have circuitry to poll each of the pads at least once during the time that contact would likely be occurring between a cushion and a pad as the result of an impact from a projectile.

The target may have a vertical sector sensor for determining the sector that is in the vertical position. In this case, the target could have switches for selecting the sector that is to be in the vertical position. The target may also detect the rotational position of the target.

The target could also have a no hit detection means for vibrationally sensing a dart hitting on or near the target and determining if contact has been made between an electroconductive area on a cushion that sits under the cup and switch contacts on a pad underneath the cushion, approximately when the dart impacted on or near the target, and if no such contact was made, providing a no hit indication.

BRIEF DESCRIPTION OF THE TABLES AND DRAWINGS

For a better understanding of the present invention and to show more clearly how it may be carried into effect, reference will now be made, by way of example, to the accompanying drawings which show preferred embodiments of the present invention and in which.

Figure 1:
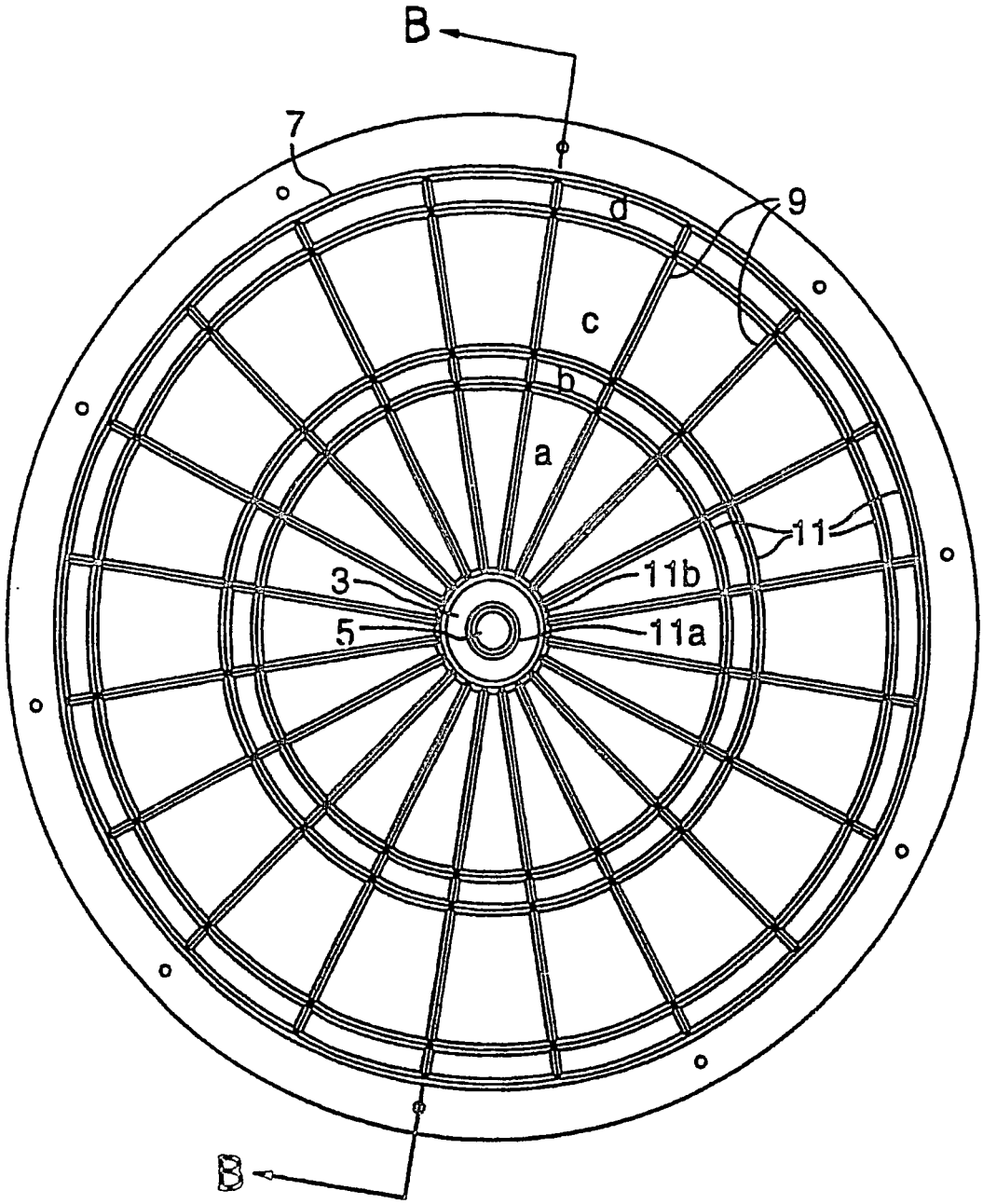
FIG. 1 is a target according to the preferred embodiment of the present invention.

FIG; 3 is an exploded perspective view from above and to one side of parts of the target of FIG. 1, including an insert, a cup, a cushion, and part of a contact board.

Figure 2:
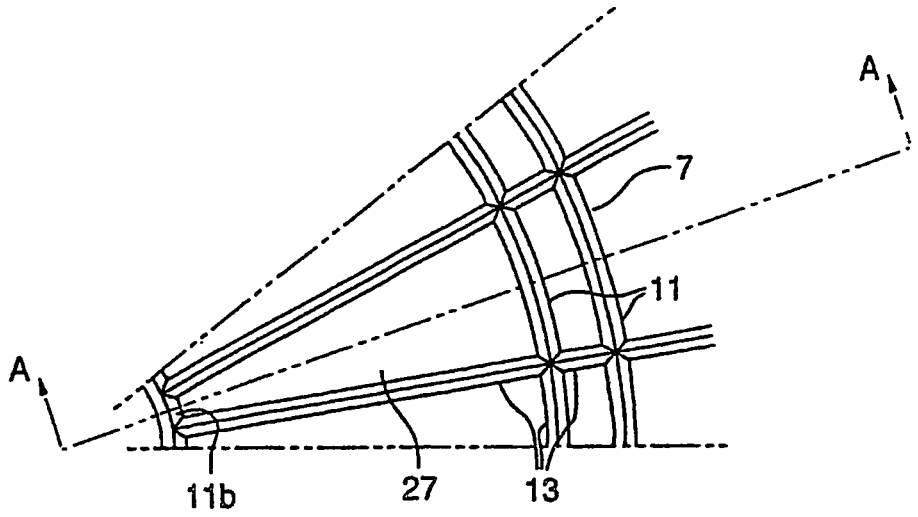
FIG. 2 is a partial top view of the target of FIG. 1, including an inner single point section and a triple point section.
Figure 4:
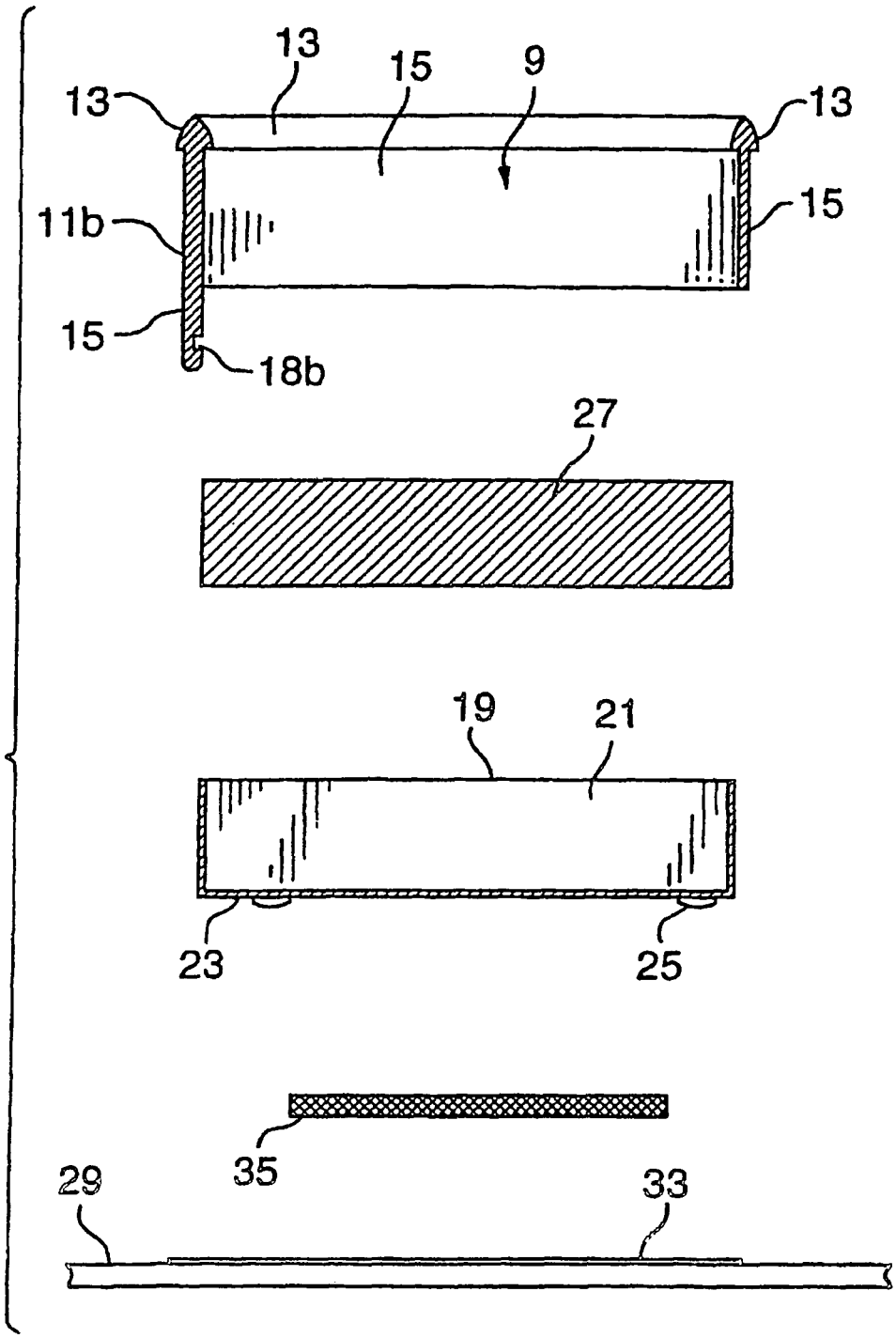

FIG. 4 is an exploded cross-section along the line A-A' of FIG. 2.

Figure 5:
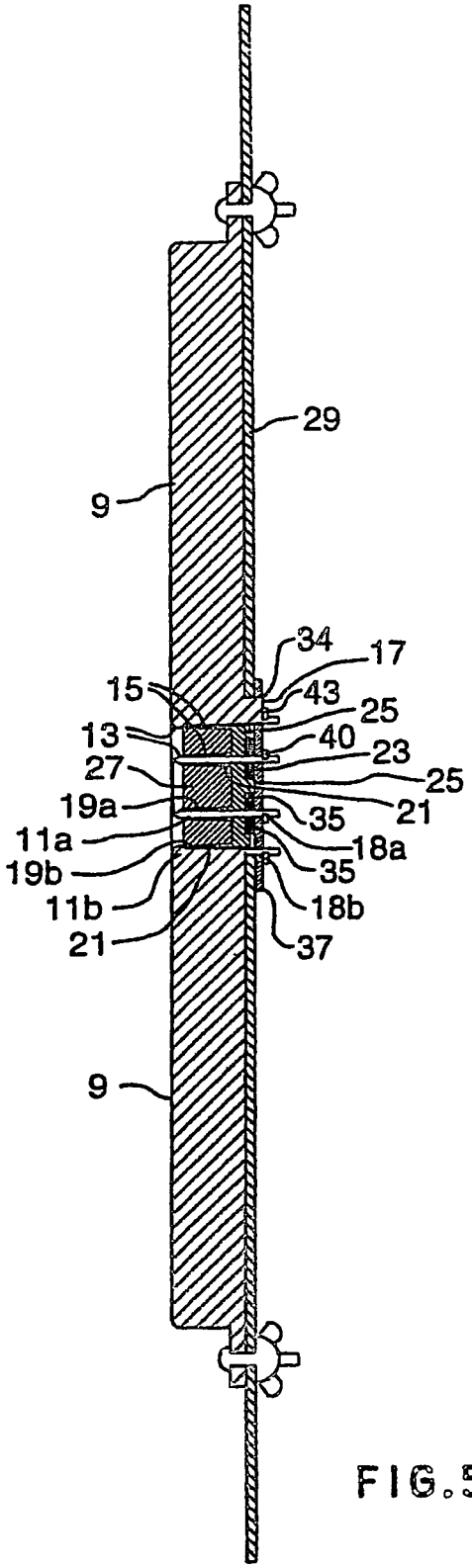
Figure 6A:
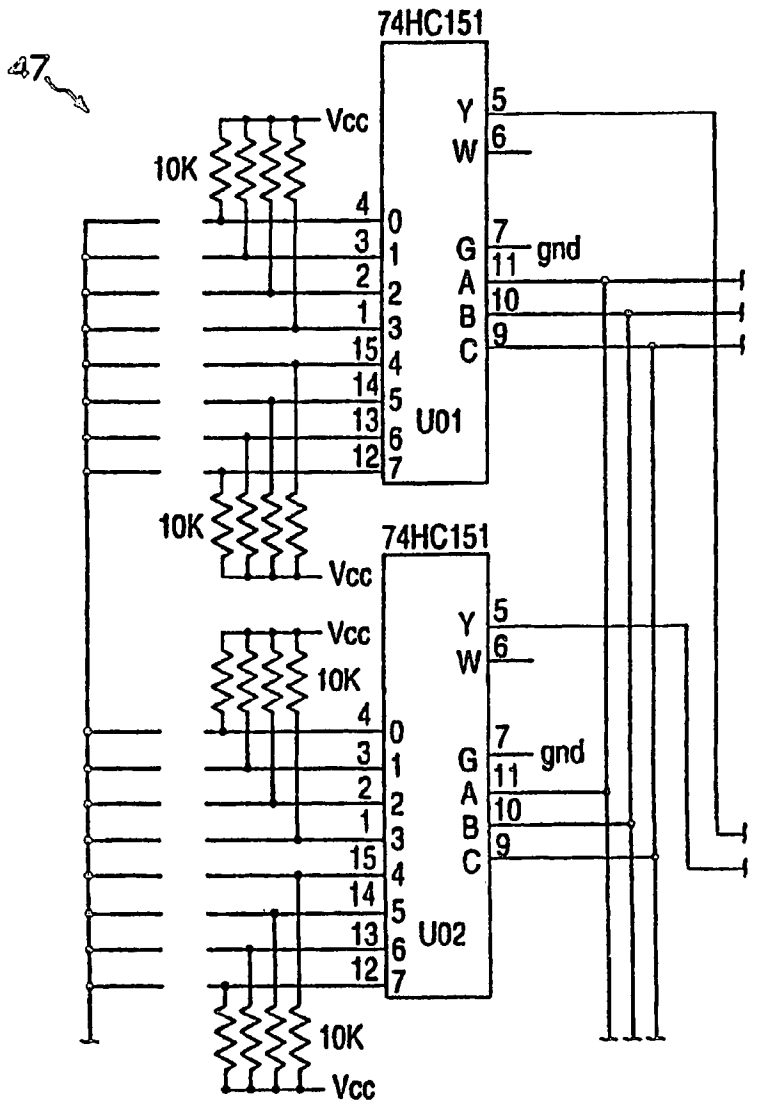
Figure 6B:
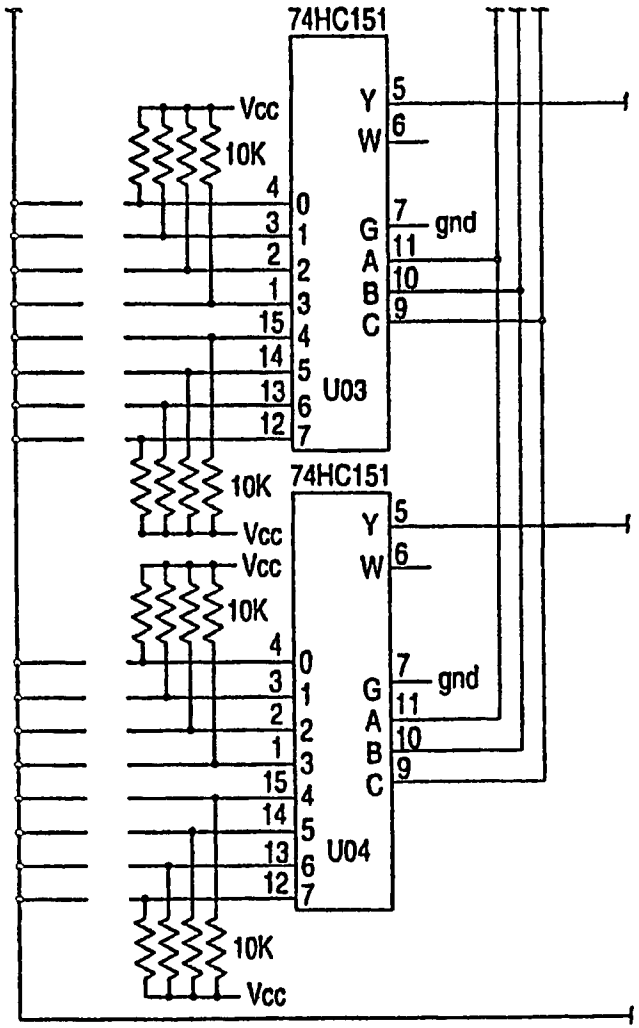
Figure 6C:
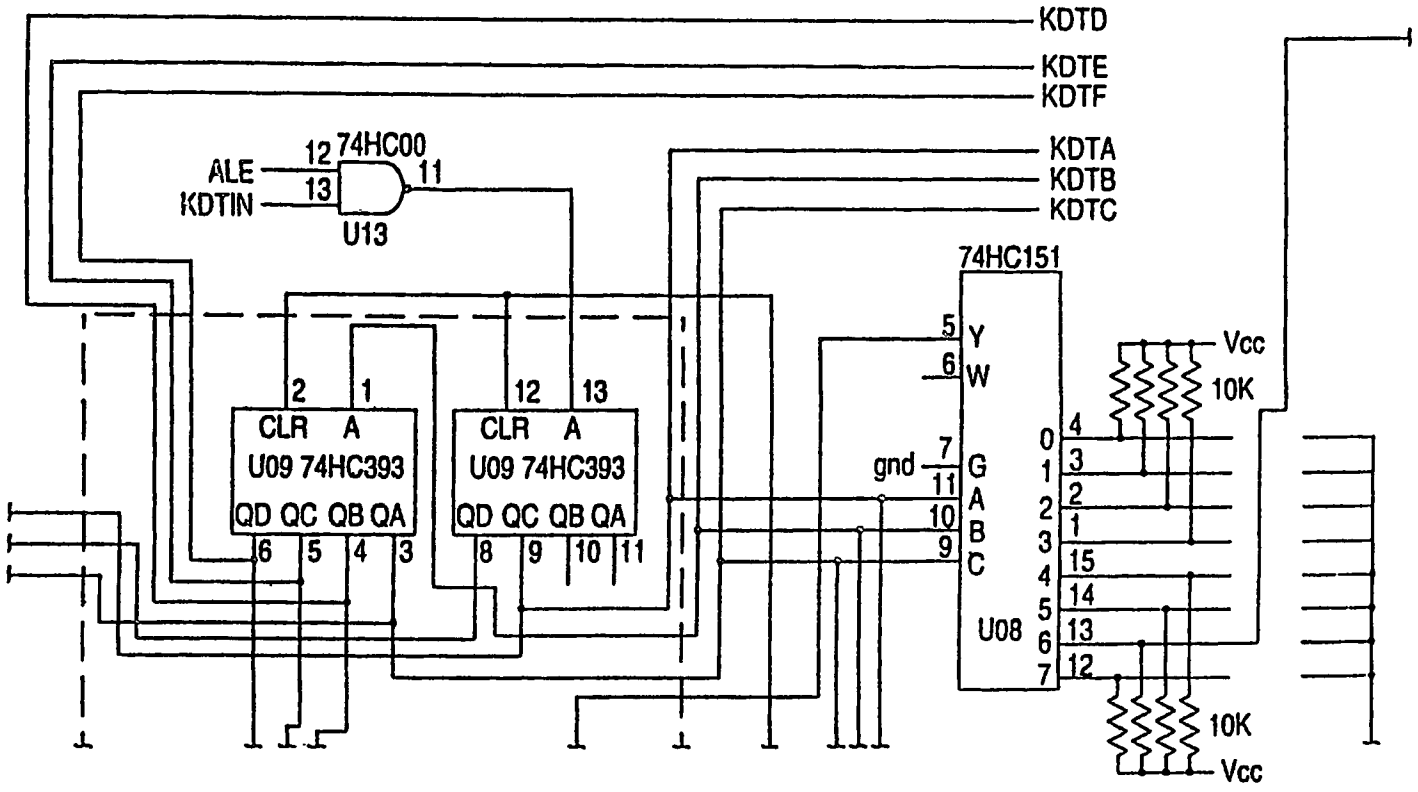
Figure 6D:
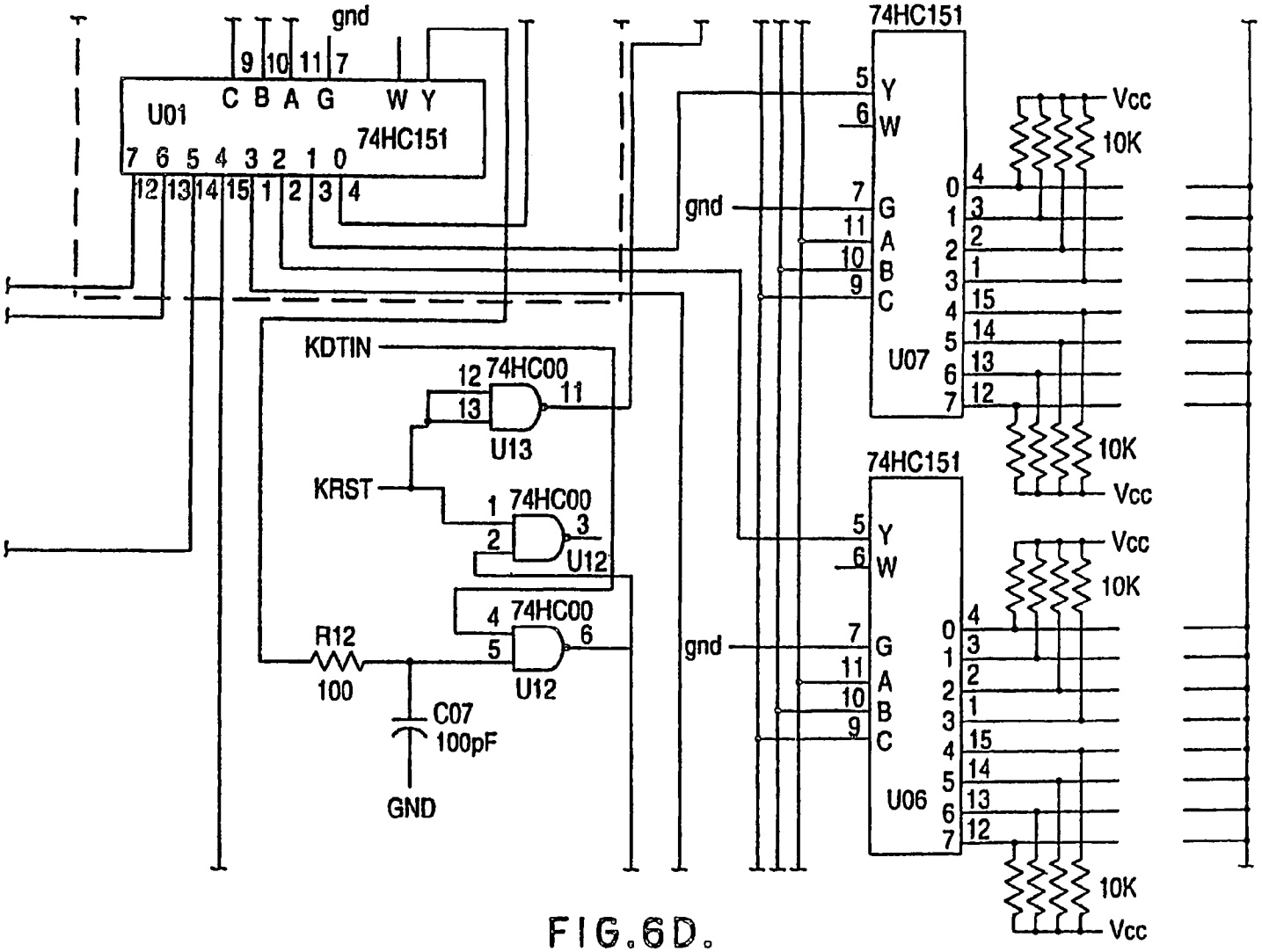
Figure 6E:
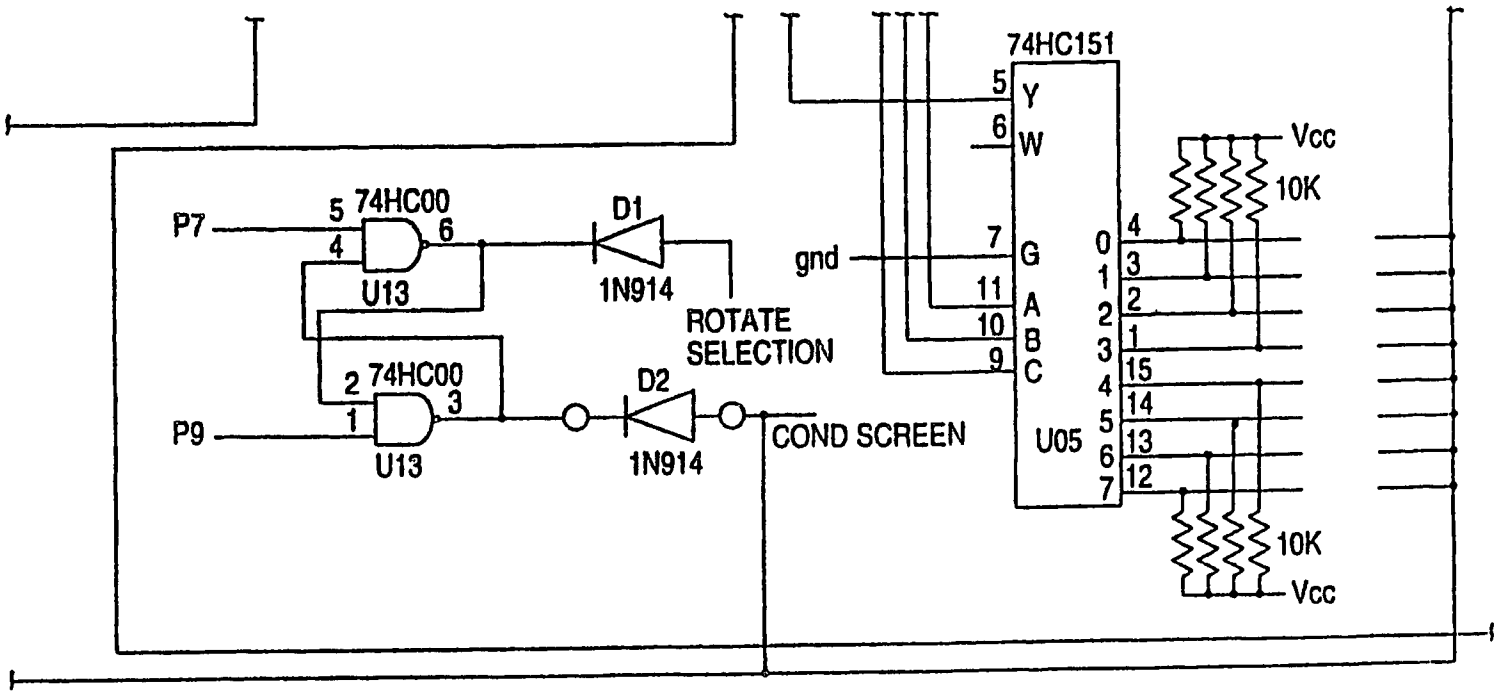
Figure 6F:
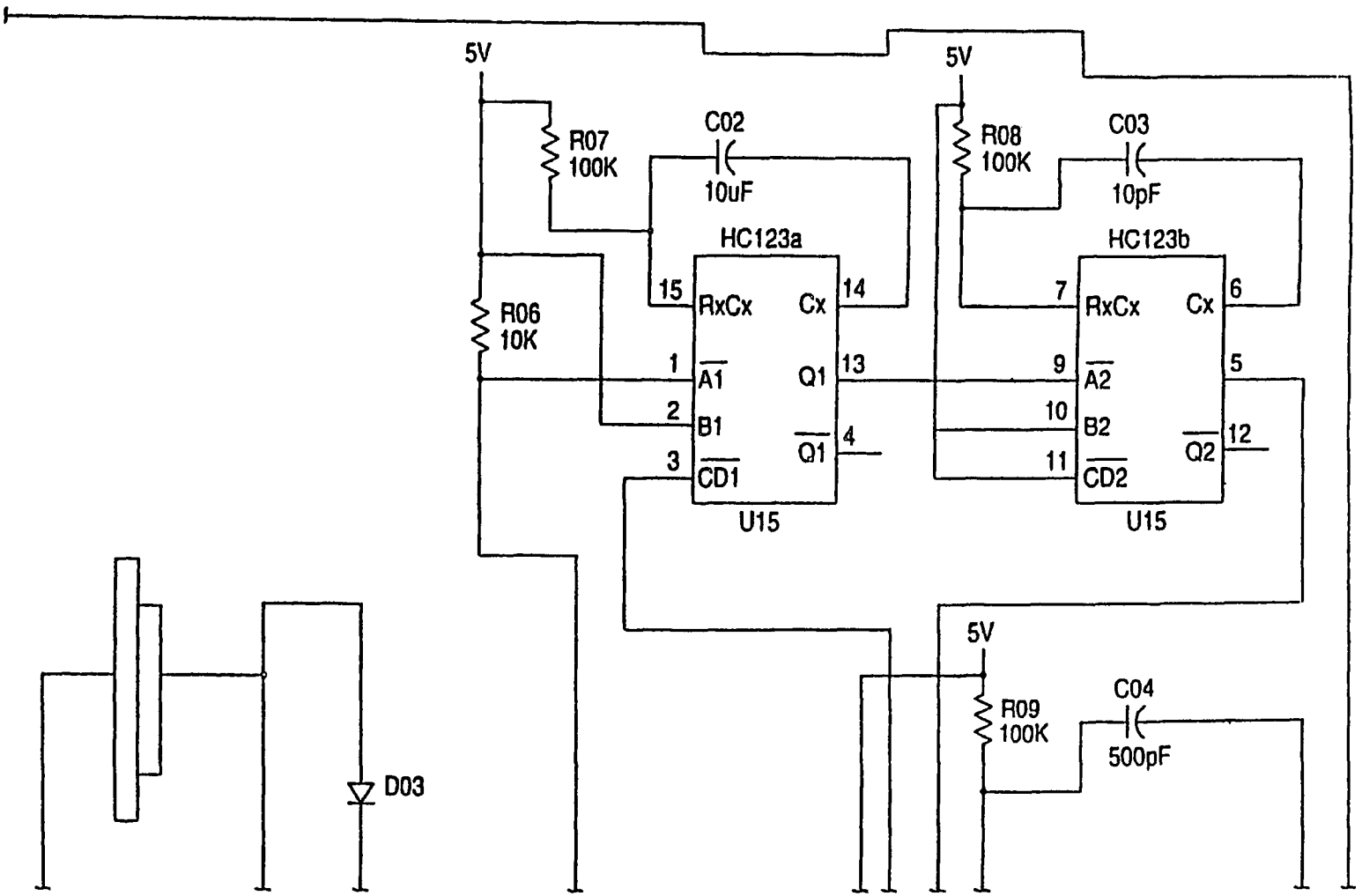
Figure 6G:
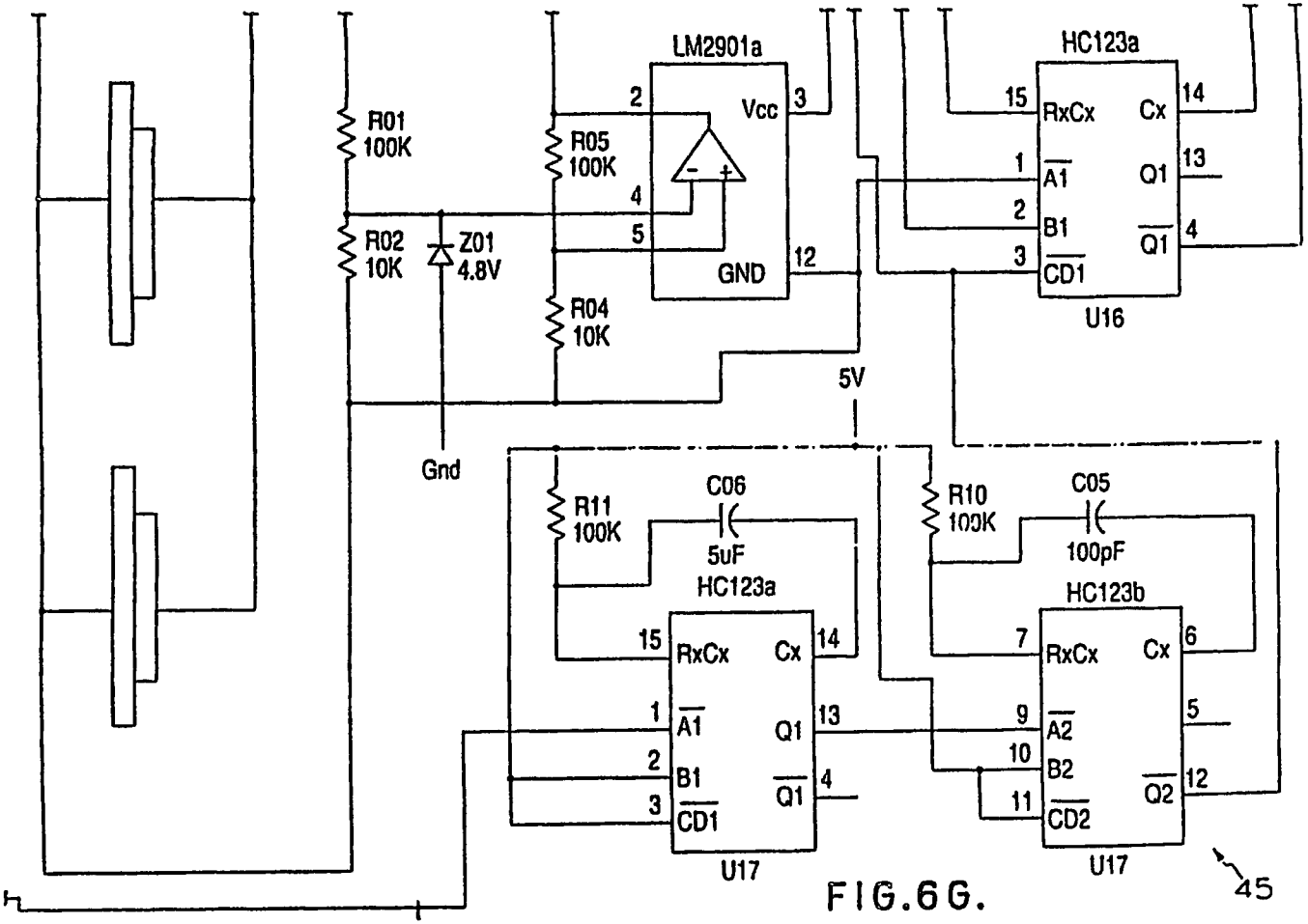

FIG. 5 is a partial cross-section along the line B-B' of FIG. 1.

FIGS. 6*a*-6*g* are partial schematic views of a target board circuit used in the target of FIG. 1.

Figure 7:
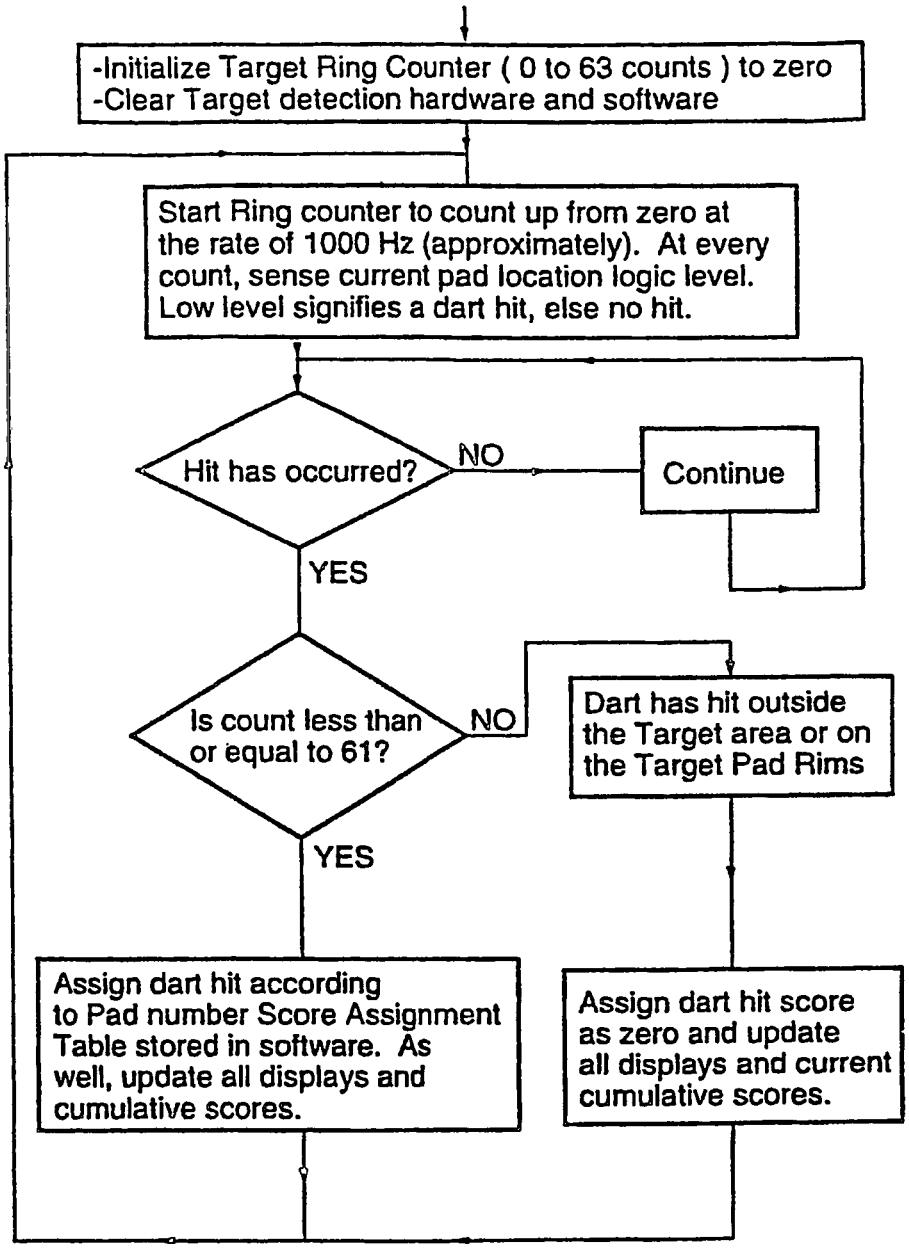

FIG. 7 is a flowchart of a program used in conjunction with the target of FIG. 1.

Figure 8A:
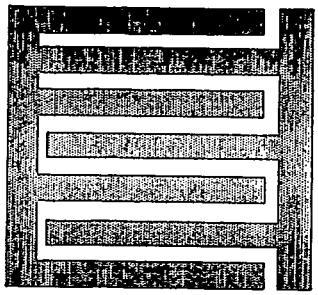

FIG. 8A is a top view of inter-digitated switch contacts.

Figure 8B:
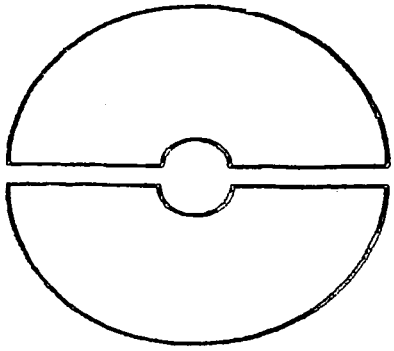

FIG. 8B is a top view of two-half switch contacts.

DETAILED DESCRIPTION OF THE PREFERRED EMBODIMENTS

The following description contains reference to specific dimensions, other quantities, and materials. These are included for ease of creating a target similar to that of the preferred embodiment. Please note that these are typical only and the invention is not limited to them. For example, the target board will be described for use with regulation grade metal tipped darts, however alternate embodiments could be configured with consequent modification to the dimensions, other quantities and materials to match the specifications of the dart (which could be plastic also) or projectile, being used. Games and sports using suitable projectiles include, for example, target gun shooting (pellet, b.b. bullets), archery, dartguns, blowguns, and games that use projectiles that are not intended to remain in the target, such as balls striking the target.

Referring to FIG. 1, a typical target board 1 is divided into 20 circular sectors surrounding a circular segment 3 and a concentric annular segment 5. Each sector is divided into a number of segments, 4 segments being shown in FIG. 1 for example as a, b, c, d, that are defined by circular arcs of different radii. The total number of segments is 82, 4 for each sector plus segments 3 and 5. This invention also includes those embodiments with different configurations and numbers of segments (at least one).

Adjacent segments of different sectors have the same relative value. Segments a and c of each sector are given a basic score, whereas the outermost segment d is double score and segment b is triple score. Thus, of the 80 segments contained in all the sectors, only 60 unique segments exist.

All sectors are the same except for their respective positions along the circumference of the target 1. The basic score that is conferred on each sector is dependent on the position of the sectors when the target 1 is installed. For example, a specific sector that is in the upper vertical position on installation usually has a basic score of 20. Adjacent to the 20 sector in the counterclockwise direction is a sector with a basic score of 5, and in the clockwise direction is a sector with the basic score of 1. Rotating the sectors clockwise by one sector will move the sector with basic score 5 into the 20 position and the one with basic score of 20 into the 1 position.

A web 7 has spokes 9 dividing each of the sectors and the web 7 typically has rings 11 radially dividing each segment from the other. Referring in particular to FIGS. 1 and 4, each of spokes 9 and rings 11 has a preferred arrow-shaped cross-section, defining tips 13 and stems 15. The spokes 9 and rings 11 may be joined wherever they cross.

Each of the stems 15, except for one on the spoke 9*a* and the ring 11*a* around segment 5 and ring 11*b* around segment 3, has preferably a depth of about 23.55 mm (approximately the same thickness as a regulation dart board) and similar width of about 1.2 mm at the bottom widening out by about 0.5 degree toward the tips 13. The tips 13 have a preferable height of approximately 4.5 mm and a width of approximately 3.8 mm at their bottom. The tips 13 have a preferred radius of approximately 6 mm with the point of each tip 13 rounded off at a radius of about 0.25 mm.

The stem 15 of spoke 9*a* has an alignment spine 17 with an additional depth of preferably approximately 6.5 mm. The stem 15 on ring 11*a* is typically approximately 30.30 mm, while that on ring 11*b* is approximately 30.30 mm preferably. The outside diameter of ring 11*a* at the base of the stem is typically approximately 20 mm, while that of ring 11*b* is 43.46 mm. Ring 11*a* does not have any connecting spokes 9 as will be discussed later. The stems 15 on rings 11*a* and 11*b* each have opposing pairs of cut-outs 18*a*, 18*b* from their bottom. The cut-outs 18*a* have a preferred depth of approximately 7.52 mm, while the cut-outs 18*b* have a preferred depth of approximately 11.255 mm. At a preferred depth of approximately 3.175 mm from the bottom of each stem on rings 11*a* and 11*b* is an annular groove 18*a*, 18*b* respectively that has a preferred height of approximately 1.17 mm.

A cup 19 is fitted for each segment of the web 7 to loosely fit within the stems 15 of the appropriate spokes 9 and rings 11 fully underneath the tips 13. The shape of the cross-section (typically arrow-like) is aimed to retain the cups 19 in the segments. Each of the cups 19, except those in segments 3, 5 have sides 21 that taper towards bottoms 23. The sides 21 of cups 19*a* and 19*b* in segments 3 and 5 respectively have differing depths for reasons that will later become apparent.

The cups 19 may be made from any material strong enough to withstand the repeated impact of very strongly thrown darts. Aluminum or zinc are possible and can be hardened by anodizing or another such technique to achieve the required strength. Non-metal composites and plastic of the appropriate strength may also be used.

An insert 27 fits and is glued into each cup 19, fitting flush with the lip of the cup 19. Sisal is the preferred material for the insert as it is relatively easy to cut, durable, provides good stopping resistance for darts, and retains darts well. Other materials, such as rubberized cork, known to be usable for dart boards could be used as inserts 27, with consequent modification to the various dimensions, if required.

As the tips 13 overlap the cups 19 and the inserts 27, the tips 13 protect the edges of the inserts 27 from damage by the darts or other projectiles. For this reason, among others, it is important to select an appropriate material for the tips 13; alternatively treat the tip 13 for increased strength, or protect the tip 13 with a separate cover. For metal grade darts, anodized aluminum, zinc or another alloy may be too soft without additional treatment or a protective cover, whereas plastic might be sufficient for plastic darts. The cups 19, which may be of a material plastic, metallic, or any other sufficiently strong to withstand repeated impacts of darts as indicated above, preferably be electrically dissipative.

Other materials could be used for the insert 27 provided they are capable of receiving and retaining the dart being used. For grade metal tipped darts, the insert 27 must also slow the dart down sufficiently so that the dart does not penetrate the cup 19, and should have a memory to fill behind the dart once it is removed. Sisal is a suitable material commonly used for dart boards. Alternatively, the insert 27 could be formed for use with plastic darts such as those shown in Jones et al. discussed previously. In that case the insert 27 would likely be made from plastic or filled with a material that is penetrable by the plastic darts.

Alternate embodiments could also be created where the functions of corresponding cups 19 and the inserts 27 are integrated into a block, not shown. The block would take the same shape as a combined cup 19 and insert 17, but would be a single unit formed from a material, such as sisal, rubberized cork, or dart penetrable plastic.

A circular main printed circuit board 29 rests beneath the web 7. The centre is cut away from the board 29 so that it fits around the stems of the ring 11*b* and protrudes into the cut-outs 18*b*, but not beneath the 25 point on segment 3. The top edge of the cut-outs 18*b* acts as a stop 31 for the board 29 to prevent it from traveling any further toward the front of the board 29. On the top of the board 29 beneath the cushion of a cup 19 are closely located switch contacts 25 typically defined by etched traces (which traces may be part of a pad 33). The purpose of this will be discussed shortly.

The board 29 has an alignment slot 34 that the alignment spine 27 fits to ensure that the board 29 is properly aligned. The board 29 is fastened near its outside edge to the web 7. A flange 34A projects outwardly from the bottom of the stem 15 of the outermost ring 13 for holding bolts or the like to fasten the web 7 to the board 29.

Although it is not shown in the preferred embodiment, the flange 34A could be altered to include a fixed well, not shown, to hold cork pieces or any other dart-receptive material, not shown, for a zero point region containing the numbers of the basic scores for each sector.

Figure 3:
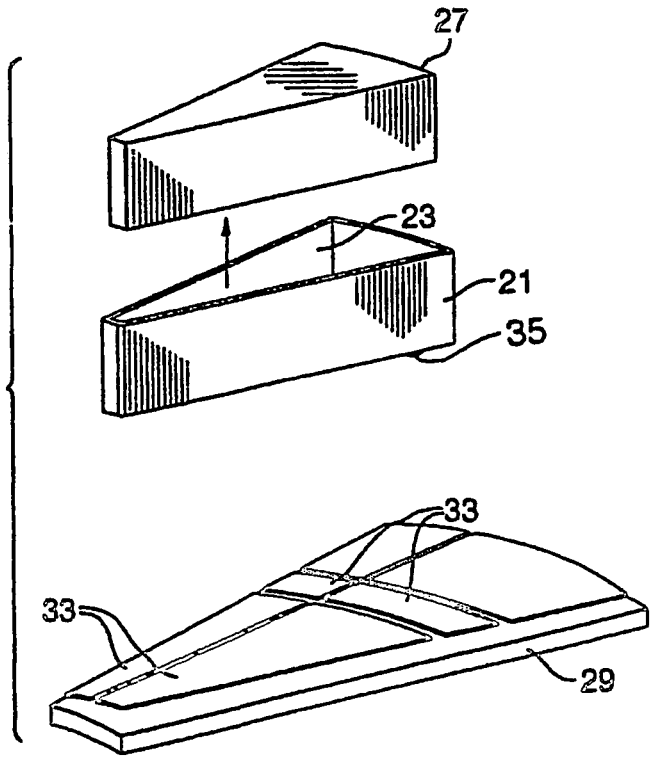

As shown in FIGS. 3 and 4, between the board 29 and each cup 19, are one or more spaced discrete resilient dielectric cushions 35. Each cushion has at least one electroconductive area (not shown). When a dart hits the target 1, it causes a cup 19 to slide towards the corresponding switch contacts 25. This compresses one or more cushions 35 and causes the at least one electroconductive area of the cushions 35 to touch switch contacts 25 (not shown) and close the switch defined by contacted switch contacts 25. The closing of the switch indicates to the underlying circuitry that a dart hit has occurred. The electroconductive area may be (or cover) a small or large portion of the cushion 35 surface adjacent to the switch contacts 25. In a preferred embodiment, the electroconductive area would be separated from the corresponding switch contacts 25 by a recessed design. One possibility is where the cushion 35 surface adjacent to the pad 33 concaves away from the switch contacts 25 in the normal state: when the cup 19 compresses the cushion 35 toward the switch contacts 25 as the result of a dart hitting the target 1, the electroconductive area, being urged towards the switch contacts 25, touches and bridges the switch contacts 25 and thereby closing the switch. As a result, a hit may be detected by the underlying circuitry. The cushion 35 then returns the cup 19 slidably to the original position prior to the hit.

Although not strictly necessary, it is recommended to have at least three and even four cushions 35 for each segment 7 (in practice, the number of cushions 35 should be dictated by the size of the cups 19) due to the tendency of the cups 19 to rotate when hit by a dart at the edge of an insert 27. When four cushions 35 are placed toward the outside edges of each of the cups 19 the likelihood that contact is made at the correct time is increased. There is a possibility, although unlikely that contact could be made and released at one cushion 35 of a cup 19 followed by contact on another cushion 35 of the same cup due to an oscillation when a dart hits. False detection of the second contact as an independent hit can be prevented in many instances by introducing some kind of time delay mechanism into the target 1. The cushion 35 is preferably glued or otherwise fastened to the cup 19 to ensure that it does not move beneath the cup 19. The cushions 35 underneath each cup 19 may also be integrated with the cup 19 and insert 27 as a single unit. A further variation is where each cushion 35 fits inside an elastomer membrane.

The dielectric material of a cushion 35 may be an elastomer (or even rubber), such as silicone, which must be sufficient to dampen the shock and vibration caused by repeated impacts of a dart on the target 1 and to return the cup 19 substantially to its original position prior to the dart hit after thousands of such impacts. The material must also be resistant to corrosion.

The switch contacts 25 must be able to withstand the force created by a dart hit over thousand of such hits and have sufficiently low resistance to closing the switch. There are a number of possible configurations of switch contacts 25. FIG. 8A illustrates inter-digitated switch contacts 25 with an non-conductive gap separating the two contacts. These contacts 25 may be result of etched tracing of the PCB as shown in FIG. 8*a*. When a dart hits a cup 19, the electroconductive area of an underlying cushion 35 would bridge the non-conductive gap between two contacts 25 and close the switch defined thereby. FIG. 8B shows two-half switch contacts. The switch contact 25 material must be resistant to corrosion.

Overlapping the interior edge of the board 29 for a small distance is a concentric twenty-five and fifty point printed circuit board 37. The board 37 has two opposing arced slots 39*a* and two opposing arced slots 39*b* that fit over the stems 15*a* and 15*b* respectively until the board 37 meets the board 29. At this point a first snap ring 40 is forced into the groove 8*b*. The boards 29 and 37 have an approximate thickness of 1.17 mm each and are snugly retained between the stop 31 and the snap ring 40.

The stem 15*a* of the ring 11*a*, which floats freely, is brought toward the board 37 until it meets the top edge of the cut-outs 18 that form a second stop 41. A second snap ring 43 is forced into the groove 8*a* and the board 37 is snugly trapped between the stop 41 and the ring 11*a*. This retains the ring 11*a*. The arced slots 39*a*, 39*b* should fit over the stems 15 fairly snugly as well to limit rotational movement of the board 37.

Other fastening means could be used in place of the snap rings 40, 43, such as threading annular locking rings, not shown, onto the stems 15*a* and 15*b*, preferably they would provide a quick release of the respective boards 29, 37 in the sense that they would not require tools or any special skill to remove.

Some form of hook or other fastening means, not shown, is used to hold the target against a wall or other substantially vertical surface. Alternatively, the target may be on a free-standing cabinet.

In order to disassemble the target, it is taken down from the wall. If the 50 point needs replacement (in heavy use), the second snap ring 43 is simply removed and the ring 11*a* slips out the front of the target. The cup 19*a*, including its insert 27 is replaced and the ring is reinserted into the target 1 with the ring 43 snapped into placed.

If the ring 11*b* needs replacement then ring 11 *a* is removed as discussed above. The target 1 is placed face down and ring 40 is then removed. This allows the board 37 to be removed for access to the cup 19*b*. That cup 19*b* can be removed and replaced. The target 1 is re-assembled in reverse order.

For access to the other cups 19, when the board 37 is removed, the board 29 is also removed by loosening the fastening devices at its outer edge. The remaining cups 19 are now accessible and can be replaced, or even interchanged if that is desired, and the target re-assembled in reverse order.

To increase the length of time that a given cup 19 may be used before replacement is required, the target 1 may be rotated so that high use sectors, the 20, 18 and 1 basic score sectors typically have the highest use, are moved to lower use sectors. It is then necessary to make the target 1 aware of the change so that automated scoring is unaffected. This will be discussed further below.

Of course, the segments in the sectors will eventually wear out and the ability to easily replace the segments using a means such as that set out above is highly advantageous.

Rotation of the segments 3, 5 does not affect the length of time they may be used, so it is also advantageous that they can be easily changed by using a means such that described previously.

The target 1 is set within a casing (or a freestanding cabinet), not shown, for protection. The casing could have the hook mentioned earlier to attach the target 1 to a wall. The casing could also have on its face the value of the basic score of each sector.

Ring Counter and Latch Circuit

Referring generally to FIGS. 6*a*-6*g*, in one embodiment of the invention a circuit 45 connects each of the 82 different segments from the pads 33 to respective inputs of multiplexers U1 through U8. This leaves 2 remaining inputs—one of which is unused, the other is connected to a no score segment as will be discussed further below.

The circuit 45 is on the printed circuit boards 29, 37. The circuit interfaces to another board, referred to as the processor board, not shown. The processor board is set behind the target 1 within the casing and is connected to the circuit 45 via a 26 conductor ribbon cable, not shown. The processor board contains a processor and a programmable read-only-memory PROM, not shown. The PROM contains computer programs for use by the processor, a 8051 may be used, to control the operation of the target 1, as described below, and also display, audio communication, coin collection and user interface functions. The display, not shown, provides a visual indication of the players scores. Audio communication, not shown, plays back suitable noises for game situations, such as a cheer when a bullseye, segment 5, is struck. The processor may communicate with a coin collection device, not shown, for receiving and calculating the amount of money put into the device by the players. The user interface, not shown, might include switches, such as On-Off, number of players or game selections. The number of players is needed for control of the target during play: it is also needed to determine how much money is needed to play. Game selections might be well known dart games, such as 301, 501, 701 or Cricket. A change in the game selection would typically require the processor to use a new scoring algorithm. Examples of these aspects of automated target boards are well known in the art and will not be further set out herein.

Integrated circuits U9, U10 and U12 implement a ring counter 47 that indicates the status of the current segment being sensed as well as physically sensing the state of the segment.

U9 contains two four bit, binary counters. The upper two bits of the first and all four bits of the second make a six bit counter with a capability to count to 64. Because the first two bits of the counter are not used, four pulses at a clock input of U9 are needed to move the counter by one. An address latch enable line (ALE) of the 8051 processor on the processor board serves as a counter clock.

Of the six counter lines, the least significant three control the one-of-eight multiplexers U1 through U8. The three control lines go to the control inputs of each of the eight multiplexers U1 through U8. Each multiplexer U1 through U9 enables one of eight segments to which it is connected to be sensed by another one-of-eight multiplexer U10. The most significant three output lines from the counter 47 control multiplexer U10 which in turn allows one of the eight lines connected to its inputs to be sensed by latch U12. This brings the state of the circuit 45 under the control of the processor board to the "Initialize . . . " box of FIG. 7. When the target is started, the ring counter 47 is set to zero.

The circuit then moves to the "Start ring counter . . . " box of FIG. 7. The counter 47 is then started and the net effect is to connect in turn each of the 63 segments to be sensed to the latch U12 allowing polling of each segment and sensing of its status.

The six counter lines are also connected through a 26 pin connector, not shown, to a processor board, not shown. These lines are shown as KDTA through KDTF on FIG. 6. The lines provide a processor board, not shown, with the identity of the segment currently being sensed by the circuit 45.

When a segment is hit by a dart, its cup 19 is pushed toward the back of the target 1 and one or more of its cushions 35 (i.e. the conductive area) contact the switch contacts 25 beneath it. Normally, one of the two contacts 25 is kept at logic low, in this case ground, and the other is at a high state. When the switch is closed by the conductive area contacting the two contacts 25 beneath it, the high state of the high contact goes low.

The inputs to the multiplexers U1 through U8 are normally held in a high state by resistors R1 tied to the supply voltage Vcc. In the event an active segment state, i.e. a segment that has been hit by a dart, causes a normally high state to go low, the low state is latched into latch U12 and the processor board is notified through line KDTIN. This way the processor board knows that a segment has been hit by a dart and exactly which segment has been hit.

The circuit 45 is in the "Hit has occurred?" and "Is count less than or equal to 61?" diamonds of FIG. 7. For the purpose of this part of the discussion, it is assumed that a hit has occurred and that the count is less than 61. If so the state flow of the circuit 45 continues to the "assign dart hit . . . " box. If there is no hit then the target simply keeps counting until a hit is sensed. To determine if the count is less than 61 a subcircuit shown in FIGS. 6*f-g* detects a dart hit and if no segment is active low, it assumes that the dart missed the target and outputs a count of 62. This is described more fully under the heading NO SCORE DETECTION below.

The circuit 45 is now in the "Is count less than or equal to 61?" diamond of FIG. 7. Upon receiving the count information, the processor updates a scoring display and sounds an appropriate sound from memory on the processor board. The processor also sends a reset pulse to the circuit via a KRST line that causes the latch U12 to reset to a high state, i.e. an inactive state.

The circuit 45 is now in the "Start Ring counter . . . " box of FIG. 7. At the same time, the KRST line resets the ring counter 47 to zero, from which point it again starts to count upwards. The polling of each segment of the target happens at least once every millisecond, thereby making it highly unlikely that a dart will hit a segment without being sensed. The polling rate may have to be increased with changes in the rebound time of the cushions 35, which will be a function of the typical dart impact weight, the resiliency of the cushion 35 and the friction between the cups 19 and web 7.

Hit and No Score Detection

In the circuit 45 is a subcircuit that first detects a hit and then detects a failure to hit any of the scoring segments, a dart has landed either in the no scoring segment or has hit the web 7 and bounced off.

This returns the circuit 45 to the "Hit has occurred?" diamond of FIG. 7. The motion of the target 1 caused by a dart hit is detected by one or more piezoelectric sensors mounted on the target 1. In the preferred embodiment 4 sensors are used, 49*a-d*. Although it is not shown on the Figures, the sensors 49*a-d* are mounted against the back of the target 1 casing equally spaced about the perimeter so as to contact the wall. Every dart hit is detected by the sensors 49*a-d* and is converted into a low TTL pulse by comparator U100. The output of the sensors 49*a-d* is clipped by a 4.8 V zener diode before being introduced into the comparator U100. The comparator U100 also contains a small amount of hysteresis in order to prevent ringing at the points of transition of the pulse. This is done by resistor R100 that connects the output of the comparator U100 to the positive input of the comparator U100.

The output of the comparator U100 is connected to two monostables U101. The first monostable U101 a generates a 800 millisecond high pulse, the falling edge of which triggers the second monostable U101*b* to generate an 8 microsecond high pulse. The rising edge of this pulse, in turn, triggers another monostable U102 to produce an 800 microsecond low pulse that is connected to the no scoring segment in the target circuit 47.

The circuit 45 is then leaving the "Hit has occurred?" box of FIG. 7 with a YES and a count of 63 to return to the "is count less than 61?" diamond described above. If within the 800 milliseconds of a first monostable U100*a* pulse, no scoring dart is sensed, the subcircuit outputs a pulse on the 63rd segment which is decoded by the processor as a dart that created zero score.

The circuit 45 is then leaving the "Hit has occurred?" diamond of FIG. 7 on the YES line and returning to the "Is count less than or equal to 61" diamond with the count as sensed above undisturbed. On the other hand, if the dart actually hit a segment which resulted in latch U13 to go low (KDTIN), another chain of events ensues. The low KDTIN triggers one of two monostables 103*a*, 103*b* to generate a 0.5 second high pulse. The falling edge of this pulse creates another low pulse in monostable U103*b*. This low pulse in turn causes U101 and U102 to be reset, thereby canceling the no score pulse that was in the process of being created and that would have resulted in a zero score at segment 63.

The use of sensors 49 to detect each hit on or near the target 1 and the circuitry 45 checking to see if a dart has hit a segment can result in a lower component implementation of the no hit function than using sensors, not shown, on and off the target 1 and comparing the difference in the signals.

Upper Vertical Sector Sensing Circuit

As discussed previously, when sectors having a high basic score get worn out earlier than sectors with low basic scores, the target 1 may simply be rotated (the preferred embodiment does this in steps of two sectors when the target 1 is powered down) in order to reassign sector basic scores. As will be described further below, the processor is notified of the specific sector that is currently in the upper vertical position by means of a bank of 10 switches, one of which is toggled ON. The switch that is toggled ON corresponds to the sector that is currently in the upper vertical position. This reduces maintenance intervals.

While the target 1 is powered, the processor board polls the target every 12 milliseconds to ascertain which sector is currently the upper vertical sector. This is done through two control lines P7, P9 that originate from the processor. It is really only necessary to poll the target 1 once when the target is powered up, however continuous polling builds some redundancy into the target 1.

Normally P9 and P7 are high and low respectively. When this state is inverted, the inverted or gate output U13 pin 6 goes low, thereby pulling one pair of basic score segments in a sector low. The pair of segments that are pulled low is determined by a bank of ten switches in which one switch is closed. With U13 pin 6 being low, the processor is informed of which sector is low by the current state of the ring counter 47. This information is stored in memory of the processor board to properly evaluate the segment that has been hit by a dart and what score to attribute to that hit.

Once the identity of the upper vertical sector is established, P9 and P7 lines revert to the high and low state respectively.

It will be appreciated that the above description relates to the preferred embodiments by way of example only. Many variations on the apparatus for delivering the invention will be clear to those knowledgeable in the field, and such variations are within the scope of the invention as described and claimed, whether or not expressly described.

What is claimed is:

1. A target for use with one or more projectiles, comprising:

a non-conductive web defining a target face and having a depth, the web defining a plurality of segments within the web that open toward the target face;

a plurality of cups comprising a non-metal composite, one or more of the plurality of cups slidably mounted and filling the target face of each of the plurality of segments and having a mouth that opens toward the target face;

an insert mounted within and filling each cup to the target face;

a back board mounted to and behind the web, the back board having a plurality of pairs of switch contacts; and a resilient dielectric cushion attached to each cup between the cup and a corresponding one of the pairs of switch contacts, the cushion having at least one conductive area facing the corresponding pair of switch contacts;

wherein each of the one or more projectiles impacting one of the inserts at the target face with sufficient force causes the cup and cushion for that insert to slide within the web and the at least one conductive area of the cushion to touch the corresponding pair of switch contacts beneath that cup, and the cushion resiliently returns the cup to its original position.

2. The target of claim 1, wherein the one or more projectiles are darts, and wherein the insert is formed from a material for generally receiving and retaining the darts.

3. The target of claim 1, wherein the insert is formed from a material for filling in behind the one or more projectiles when the one or more projectiles are removed.

4. The target of claim 1, wherein the insert is formed from a material chosen from a group that includes a plastic, a sisal, and a rubberized cork.

5. The target of claim 1, wherein the insert is glued to its respective cup.

6. The target of claim 1, wherein each cushion is formed from elastomer.

7. The target of claim 1, wherein the web further comprises a plurality of concentric spaced apart rings and a plurality of equally spaced spokes emanating from a second innermost ring, the spokes defining circular sectors, the two innermost rings defining two of the plurality of segments, and intersecting spokes and rings defining remaining ones of the plurality of segments.

8. The target of claim 7, wherein the innermost ring is connected by a quick release mechanism to the back board for quick removal of the innermost ring and easy access to the cup in the innermost ring for removal of that cup from the target.

9. The target of claim 8, wherein the quick release mechanism comprises at least one first extension of the innermost ring through the back board, the at least one first extension having a first groove parallel to the back board for receiving a first snap ring that maintains the back board snugly against an unextended portion of the innermost ring.

10. The target of claim 9, wherein the back board comprises a main board and a centre board, wherein the main board has an area beneath the entire inside diameter of the second innermost ring removed, and the centre board extends beneath that area and overlaps the main board, wherein the at least one first extension extends through the centre board and the second innermost ring has at least one second extension of the second innermost ring through the centre board, the main board having projections beneath an unextended portion of the second innermost ring, the at least one second extension having a second groove parallel to the centre board for receiving a second snap ring that maintains the centre board and main board snugly against the unextended portion of the second innermost ring.

11. The target of claim 7, wherein the web has a tip on each of the rings and spokes that extends into the plurality of segments and retains each of the cups.

12. The target of claim 11, wherein the tip covers the entire face of the web and covers the entire rim of each cup.

13. The target of claim 12, wherein the tip is made from a material that can withstand the impact of the one or more projectiles over a long period of use.

14. The target of claim 13, wherein the tip is made from plastic and the web is covered by a protective spider for withstanding the impact of the one or more projectiles.

15. The target of claim 7, wherein the web has 6 rings, and the back board conductively connects the pairs of switch contacts beneath the plurality of segments in the same sector between the second innermost and third innermost rings and the fourth innermost to the fifth innermost rings.

16. The target of claim 15, wherein the target has circuitry to poll each switch comprising the pair of switch contacts at least once during the time that contact would likely be occurring between the cushion of one of the plurality of cups and the corresponding pair of switch contacts as the result of an impact from the one or more projectiles.

17. The target of claim 16, wherein contact between a conductive area and the pair of switch contacts results in a closed circuit between the pair of switch contacts, and polling by the circuitry senses the closed circuit.

18. The target of claim 17, further comprising a vertical sector sensor operable to determine the sector that is in the vertical position.

19. The target of claim 18, further comprising selection switches for selecting the sector that is to be in the vertical position.

20. The target of claim 16, further comprising no hit detection circuitry operable to sense a vibration of a dart hitting on or near the target and to determine if a contact has been made between the conductive area of the cushion and the corresponding pair of switch contacts when the dart impacted on or near the target, and if no such contact was made, to provide a no hit indication.

21. The target of claim 7, further comprising position detection circuitry operable to determine the rotational position of the target.

22. The target of claim 21, further comprising a vertical sector sensor operable to determine the sector that is in the vertical position.

23. The target of claim 22, further comprising selection switches for selecting the sector that is to be in the vertical position.

24. The target of claim 7, further comprising no hit detection circuitry operable to sense a vibration of the one or more projectiles hitting on or near the target and to determine if contact has been made between the cushion and the corresponding pair of switch contacts when the one or more projectiles impacted on or near the target, and if no such contact was made, to provide a no hit indication.

25. The target of claim 7, further comprising circuitry for normally holding one of two switch contacts comprising one of the pairs of switch contacts at a first potential and the other switch contact at a second potential, and sensing when the one or more projectiles have impacted a given segment by determining when the one of the two switch contacts has momentarily taken the potential of the other switch contact through contact with the conductive area of the cushion.

26. The target of claim 25, wherein the circuitry determines when the one of the two switch contacts has momentarily taken the potential of the other switch contact of the same pad by polling the one of the two switch contacts at a rate greater than the time the conductive area of the cushion corresponding to the pad is likely to remain in contact with the two switch contacts.

27. The target of claim 1, wherein the non-metal composite comprises a plastic material.

28. The target of claim 1, wherein the back board is a printed circuit board and the pairs of switch contacts are traces on the back board.

29. The target of claim 28, wherein the traces form part of a pad on the back board.

30. The target of claim 1, wherein the cushion surface concaves away from the corresponding pair of switch contacts when the cushion is not in contact with the corresponding pair of switch contacts.

31. The target of claim 1, wherein one or more of the pairs of switch contacts are inter-digitated switch contacts.

32. The target of claim 1, wherein one or more of the pairs of switch contacts are half switch contacts.

* * * * *